US005752612A

United States Patent [19]

Fritzsche et al.

[11] Patent Number: 5,752,612

[45] Date of Patent: May 19, 1998

[54] SELF CLOSING OPENING MEMBER

[76] Inventors: Rodger Erich Fritzsche, 47 Dovecote, Middle Rasen Lincolnshire LN8 3UD; Alan L. G. Bearne, 26 Coverdale, Kingsthorpe Northhampton NN2 8UU, both of England

[21] Appl. No.: 780,096

[22] Filed: Dec. 24, 1996

Related U.S. Application Data

[63] Continuation of Ser. No. 382,871, Feb. 3, 1995, abandoned.

[30] Foreign Application Priority Data

Feb. 7, 1994 [GB] United Kingdom ..... 9402298

[51] Int. Cl.[6] ..... B65D 43/06

[52] U.S. Cl. ..... 215/301; 215/201; 215/216; 215/224; 215/295; 215/305

[58] Field of Search ..... 215/213, 216, 215/224, 225, 227, 254, 295, 301, 305, 201, 302, 304; 220/326; 225/153.14

[56] References Cited

U.S. PATENT DOCUMENTS

| | | | |
|---|---|---|---|
| 871,697 | 11/1907 | Hofheimer | 215/302 |
| 3,578,192 | 5/1971 | Sonne . | |
| 3,625,386 | 12/1971 | Schaefer . | |
| 3,792,803 | 2/1974 | Kessler . | |
| 3,860,135 | 1/1975 | Yung et al. . | |
| 3,924,768 | 12/1975 | Lemons . | |
| 4,065,017 | 12/1977 | Burton . | |
| 4,146,146 | 3/1979 | Mar | 215/213 |
| 4,215,796 | 8/1980 | Johnson et al. . | |
| 4,358,022 | 11/1982 | Gelger . | |
| 4,371,095 | 2/1983 | Montgomery et al. . | |
| 4,449,638 | 5/1984 | Davis . | |
| 4,462,501 | 7/1984 | Franchi . | |
| 4,512,484 | 4/1985 | Mar . | |
| 4,535,903 | 8/1985 | Franchi | 215/213 |

FOREIGN PATENT DOCUMENTS

| | | | |
|---|---|---|---|
| 7752475 | 2/1975 | Australia . | |
| 0609955A1 | 8/1994 | European Pat. Off. . | |
| 739968 | 1/1933 | France | 215/302 |
| 816301 | 8/1937 | France | 215/302 |
| 1219174 | 1/1971 | United Kingdom . | |
| 1431498 | 4/1976 | United Kingdom . | |
| 1433597 | 4/1976 | United Kingdom . | |
| 2108094 | 5/1983 | United Kingdom . | |
| WO9325445 | 12/1993 | WIPO . | |

*Primary Examiner*—Allan N. Shoap
*Assistant Examiner*—Robin A. Hylton
*Attorney, Agent, or Firm*—Kaplan & Gilman, LLP

[57] ABSTRACT

A closure 1 for a container comprises a slidable opening member 3 slidable between a retracted position and an extended position. In the retracted position, substantially no opening force can readily be applied to the opening member 3. In the extended position, an opening force can be applied to the opening member 3 to open the container. A spring or similar device is provided for automatically returning the opening member to the retracted position.

23 Claims, 2 Drawing Sheets

SELF CLOSING OPENING MEMBER

This is a continuation of application Ser. No. 08/382,871, filed Feb. 3, 1995, now abandoned.

BACKGROUND OF THE INVENTION

1. Field of the Invention

The present invention relates to a closure for a container, more especially to a safety closure which offers at least some measure of resistance to unintended opening by children. Such closures are sometimes referred to as "child resistant closures" or simply "CRCs".

2. Statement of the Prior Art

The closure of the present invention belongs to that class of child resistant closures which, when in the "safe" configuration offer little, or substantially no protruberance, surface or formation on which a child can readily gain a grip. To open such closures, a retracted opening member must be pulled from the retracted position to an extended position, whereby, the user may gain purchase on the opening member. Then, a force applied to the opening member enables the closure to be opened. CRCs of this type will hereinafter be referred to as non-grippable CRCs.

A variety of designs have been proposed for non-grippable CRCs, such as are described in the following published patent specifications: GB 2 108 094 A; U.S. Pat. No. 4,358,022; U.S. Pat. No. 4,462,501; and U.S. Pat. No. 4,535,903. However, all these designs have the disadvantage that if one forgets after use, to push the opening member back into the retracted position, a child then finding the container with such a closure will readily be able to open it.

Flip-top closures are another generally known form of closure, e.g. as described in GB 1 433 597, GB 1 431 498 and GB 1 219 174. Another kind of CRC but in the flip-top category is disclosed in the specification of U.S. Pat. No. 4,371,095 in which a circular lid is chordally hinged so that when the lid is pressed, part thereof tilts upwardly to be gripped and opened. If the sides of the closure are not gripped to pinch the lid and the lid is released, the resilience of the hinge causes the lid to close again. However, the part of the lid to be pressed is readily accessible so that a child could accidentally open the closure with relative ease. Moreover, positive closing upon release of the lid is only possible because the closure is of the kind in which a spigot closes a relatively narrow orifice by interference fit. The design is not readily suited to wider-mouthed closures.

SUMMARY OF THE INVENTION

A new type of closure has now been devised which overcomes the aforementioned problem. Thus, the present invention provides a closure for a container, the closure comprising a body and a slidable opening member slidably movable between a retracted position in which substantially no opening force can readily be applied thereto and an extended position in which an opening force may be applied thereto to open the container, and wherein retraction means is provided for automatically returning the opening member to the retracted position.

As well as preventing the opening member from remaining in the unextended position, the retraction means can, in at least some embodiments, exert a resistance such that a very young child could not withdraw the opening member, even if that child could identify the opening member. However, the main child resistant feature is that slidable retraction of the opening member makes the opening member difficult to grip until successfully extended.

Preferably, the body is configured to enclose the opening member so that only part thereof is accessible when the opening member is in the retracted position. The opening member can be provided with engagement means for enabling it to be engaged by a finger or a finger nail, e.g. as one or more ribs, grooves, knurls or other surface roughness feature. The opening member may be provided with a tab on an outward facing part thereof. The engagement means may be provided on such a tab.

The opening member may be arranged to be slidable through an opening in at least a side wall of the body. The opening can be of any convenient shape, for example a cut-away portion (e.g. slot shaped) for accepting the opening member when in the retracted position.

In a preferred embodiment, the opening member is generally elongate. Then, the opening member may be slidable along the longitudinal axis thereof. Moreover, the opening member may be slidable along a radial path relative to a vertical axis (e.g. axis of symmetry) of the body.

Preferably, the retraction means is in the form of a spring means for adopting a stressed condition when the opening member is in the extended position and in a relaxed condition when the opening member is in the retracted position. In a preferred embodiment, the spring means comprises a first link member, linking the opening member to the body of the closure. Most preferably, there is also a second link member, linking the opening member to the closure body. In the preferred embodiment, two link members extend outwardly from the opening member, on respective sides thereof, the opening member being generally elongate. Most preferably, the link member or members is/are bendable barb-shaped spring member(s).

The link member(s) may be formed integrally with the body and/or the opening member but conveniently the closure, including the opening member, together with any link member(s) is formed integral as a one-piece closure. Most preferably, the closure is formed of a plastics material, for example polypropylene and is manufactured by injection moulding.

In the alternative to a radially extendable sliding opening member, the opening member could be pivoted to slide into and out of the body.

Of course, other forms of spring means are possible, for example formed of an elastic material or utilising a coil spring, e.g. a compression or extension spring.

The closure may be integral with a container but have a separable lid-part or it may be an entirely separate item to be placed on or removed from the container, as desired. Thus, the closure preferably then is provided with means for attaching it to a container. It may also have a tear-strip for preventing opening prior to removal of the tear-strip. The closure may also have a hinge enabling it to be hingeably opened whilst attached to a container.

BRIEF DESCRIPTION OF THE DRAWINGS

The present invention will now be explained in more detail by way of the following description of a preferred embodiment and with reference to the accompanying drawings, in which.

DESCRIPTION OF THE PREFERRED EMBODIMENTS

Figure 1:
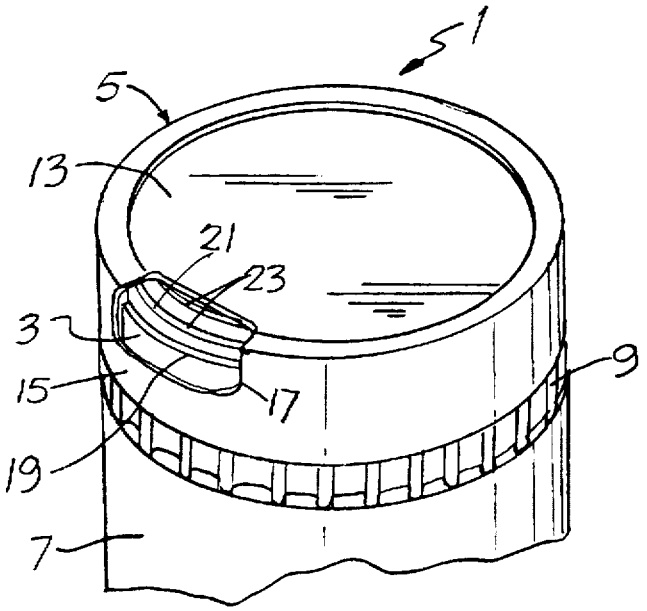
FIG. 1 shows a rear perspective view of a first embodiment of a closure according to the present invention.
Figure 2:
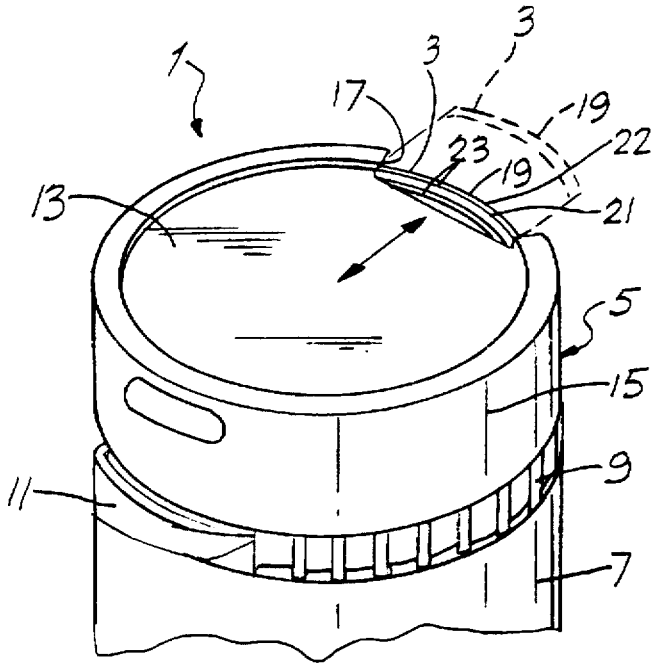
FIG. 2 shows a front perspective view of the closure shown in FIG. 1.

As shown in FIGS. 1 and 2, a first embodiment of a closure 1 according to the present invention is provided with an opening member 3. The opening member 3 is slidably moveable between a retracted position as shown in FIG. 1 and in solid line in FIG. 3, and an extended position as shown in phantom in FIG. 3.

The closure comprises a substantially cylindrical body 5, although it could be of any convenient shape, determined for example by aesthetic considerations, function, and the shape of the container 7 (shown in part only) to which it is attached. In this embodiment, the closure 1 is attached to the container 7 by means of a conventional tear-strip 9 which is removable by pulling on a tab 11. The closure 1 cannot be removed to open the container 7 until the tear-strip is torn away.

The substantially cylindrical closure body 5 has a substantially flat top 13 and a cylindrical side wall 15. A slot-shaped opening 17 is formed in the vicinity of the junction of the top and side wall, along a relatively small section of the circumference of the body, so that the opening member 3 is accessible.

Figure 3:
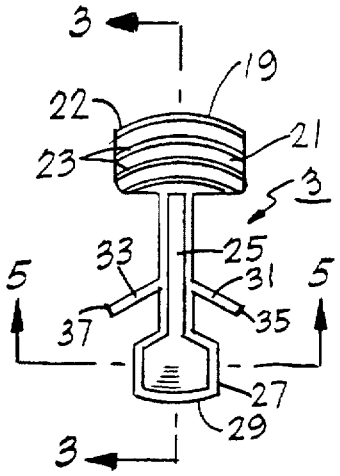
FIG. 3 shows an opening member of the closure shown in FIGS. 1 and 2.
Figure 5:
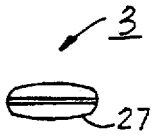
FIG. 5 shows a section along B—B in FIG. 3.
Figure 4:
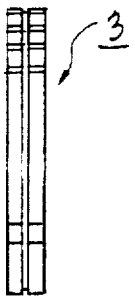
FIG. 4 shows a section along A—A in FIG. 3.

As shown in FIG. 3, the opening member is generally elongate. A first end 19 is in the form of a thumb tab 21, the outward end 22 of which constitutes the part accessible through the slot-shaped opening 17. The thumb tab 21 is provided with ridges/depressions 23 to assist gripping between the fingers or engagement with a finger nail.

The thumb tab 21 is joined by a central spine section 25 to a pressure member 27 at a second end 29 of the opening member 3, remote from the first end 19. Approximately two-thirds of the way along the spine 25, from the thumb tab 21 to the pressure member 27 are formed right and left barb springs 31, 33 respectively, extending outwardly therefrom, angled backwards, away from the thumb tab 21 and towards the pressure member 27 at about 45° to the spine.

Figure 6:
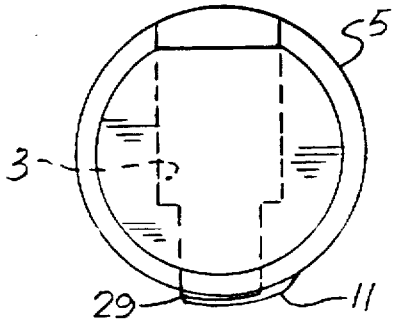
FIG. 6 shows a top view of the closure shown in FIGS. 1 and 2, with a recess shown in phantom.

The closure 1, including the opening member 3 with its barb springs 31, 33 are injection moulded, integral as a single piece, out of polypropylene. The respective ends 35, 37 are joined to the underside of the top 13. The opening member 3 as a whole is entrained within a recess 39 (see FIG. 6) within the underside of the top 13.

Referring again to FIGS. 1 and 2, it will be appreciated that in the normal position, the opening member 3 will be retracted so that only the thumb tab 21 will be accessible through the slot-shaped opening 17. In this state, even with the tear-strip 9 removed, the closure is generally too smooth to be removed easily from the container 7 by a child. However, if the thumb tab 21 is gripped then it can be withdrawn through the slot (FIG. 2) to extend proud thereof.

To withdraw the tab thus requires a force to be exerted against the spring resistance exerted by the barb springs 31, 33 which are deformed by flexing, due to their ends 35, 37 remaining fixed to the underside of the top 13 whilst the opening member is pulled outwardly through the slot-shaped opening 17. Then, an opening force can be applied to the closure by means of the thumb tab 21 of the opening member 3. Conveniently, this can be effected by pressing downwards on the thumb tab so that the pressure member 27 exerts an upward pressure against the underside of the top 13. In this way the top is removed.

Upon releasing contact with the thumb tab 21, the barb springs 31, 33 naturally return to their original unflexed state, thereby retracting the opening member 3 so that only the tip 22 of the thumb tab is again accessible. To re-close the container 7, it is simply pushed back on. It will be appreciated that the closure may be removably fitted to the container by any convenient means, e.g. snap-fit and optionally, may be hinged thereto.

Figure 7:
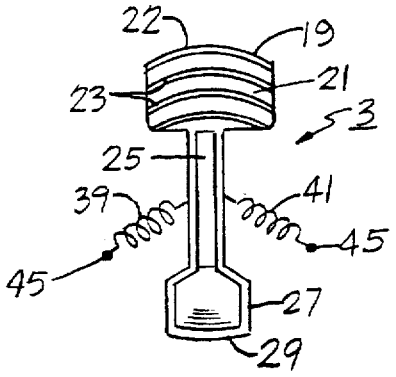
FIG. 7 shows a detail of a second embodiment of the present invention, corresponding to that of FIG. 3 of the first embodiment.

FIG. 7 shows a detail of a second embodiment of the invention corresponding to FIG. 3 of the first embodiment. Here, the opening member 3 is exactly the same as that of FIG. 3 except that the barb springs 31, 33 are replaced by respective metallic coil springs 39, 41. The coil springs are anchored at their respective ends 43, 45 remote from the spine section 25 to the underside of the top 13. In FIG. 7, all reference numerals otherwise correspond to those in FIG. 3 to denote the same components and the remainder of the closure is otherwise excactly the same as shown in FIGS. 1, 2 and 4 to 6.

In the light of this disclosure, modifications of the described embodiment, as well as other embodiments, all within the scope of the present invention as defined by the appended claims will now become apparent to persons skilled in the art.

We claim:

1. A closure for a container, the closure being configured to engage the container and comprising a body and an elongate opening member having opposing ends, wherein the body is configured to enclose substantially the entire portion of the opening member but with one end accessibly exposed and comprises an opening through which the opening member is longitudinally slidable between a retracted position in which only an end portion of the opening member is accessible, and an extended position in which a larger portion of the opening member is accessible so as to form a lever to which a downward opening force is applied sufficient to overcome friction between the closure and the container and open the container, and wherein retraction means is provided for automatically returning the opening member to the retracted position.

2. A closure according to claim 1, wherein the opening member is slidable along a radial path relative to a vertical axis of the body.

3. A closure according to claim 1, wherein the end portion of the opening member which is accessible in the retracted position is provided with engagement means for enabling it to be engaged by one of a finger and a finger nail.

4. A closure according to claim 1, wherein the opening in the body is in at least a side wall of the body.

5. A closure according to claim 4, wherein the opening is a cut-away portion for accessing the opening member when in the retracted position.

6. A closure according to claim 1, wherein said retraction means comprises spring means for adopting a stressed condition when the opening member is in the extended position and a relaxed condition when the opening member is in the retracted position.

7. A closure according to claim 6, wherein said spring means comprises at least one link member linking said opening member to the closure body.

8. A closure according to claim 7, wherein first and second said link members are joined respectively to either side of said opening member.

9. A closure according to claim 7, wherein said at least one link member is a bendable barb-shaped member.

10. A closure according to claim 7, wherein said at least one link member is formed integral with said opening member.

11. A closure according to claim 7, wherein the body comprises a top portion and the at least one link member joins said opening member to the underside of said top portion.

12. A closure according to claim 1, wherein said opening member comprises one end which is accessible when the opening member is in the retracted position and an opposite end which is provided with a paddle which exerts an upward pressure upon the underside of the top of the closure body when downward pressure is exerted upon the opposite end of the opening member, so as to remove the closure from the container.

13. A closure for a container, the closure being configured to engage the container in a friction-fit, the closure comprising a body and an opening member having opposing ends, wherein the body is configured to enclose substantially the entire portion of the opening member but with one end accessibly exposed and comprises an opening through which the opening member is pivotally slidable between a retracted position in which only an end portion of the opening member is accessible to which substantially no opening force can readily be applied and an extended position in which a larger portion of the opening member is accessible to which a downward opening force is applied so as to overcome friction between the closure and the container created by the friction-fit engagement between them and open the container, and wherein retraction means is provided for automatically returning the opening member to the retracted position.

14. A closure according to claim 13, wherein the accessible portion of the opening member when it is in the retracted position is provided with engagement means for enabling it to be engaged by one of a finger and a finger nail.

15. A closure according to claim 13, wherein the opening the body is in at least a side wall of the body.

16. A closure according to claim 13, wherein the opening is a cut-away portion for accessing the opening member when in the retracted position.

17. A closure according to claim 13, wherein said retraction means comprises spring means for adopting a stressed condition when the opening member is in the extended position and a relaxed condition when the opening member is in the retracted position.

18. A closure according to claim 17, wherein said spring means comprises at least one link member linking said opening member to the closure body.

19. A closure according to claim 18, comprising first and second link members wherein first and second said link members are joined respectively to either side of said opening member.

20. A closure according to claim 18, wherein said at least one link member is a bendable barb-shaped member.

21. A closure according to claim 18, wherein said at least one link member is formed integral with said opening member.

22. A closure according to claim 18, wherein the body comprises a top portion having an underside and the at least one link member joins said opening member to the underside of said top portion.

23. A closure according to claim 13, wherein said opening member is further provided with pressure means for bearing upon said closure body.

* * * * *